United States Patent [19]

Ellermann et al.

[11] Patent Number: 4,815,404

[45] Date of Patent: Mar. 28, 1989

[54] SERVO DEVICE FOR A MULTINEEDLE SEWING MACHINE WITH ENGAGEABLE AND DISENGAGEABLE NEEDLE BARS

[75] Inventors: Rolf Ellermann; Wilhelm Stapel, both of Bielefeld; Gunter Droste, Leopoldshohe, all of Fed. Rep. of Germany

[73] Assignee: Durkoppwerke GmbH, Fed. Rep. of Germany

[21] Appl. No.: 222,478

[22] Filed: Jul. 21, 1988

[30] Foreign Application Priority Data

Jul. 24, 1987 [DE] Fed. Rep. of Germany ..... 3724506

[51] Int. Cl.[4] ..... D05B 19/00; D05B 1/08; D05B 47/04

[52] U.S. Cl. ..... 112/121.11; 112/163; 112/255; 112/275; 112/221

[58] Field of Search ..... 112/163, 221, 121.11, 112/275, 272, 2, 262.1, 315, 254, 255, 314

[56] References Cited

U.S. PATENT DOCUMENTS

| | | | |
|---|---|---|---|
| 4,495,877 | 1/1985 | Willenbacher | 112/121.11 |
| 4,534,304 | 8/1985 | Reinke | 112/121.11 X |
| 4,736,699 | 4/1988 | Dobner et al. | 112/121.11 X |

*Primary Examiner*—Peter Nerbun

*Attorney, Agent, or Firm*—Ostrolenk, Faber, Gerb & Soffen

[57] ABSTRACT

A servo device for a multineedle sewing machine which includes two needle bars; driving and stop devices for said needle bars; devices for engaging and disengaging the two needle bars relative to the driving and stop devices; a feed-length adjustment device associated with at least one feed dog for the transport of the material being sewn; an adjustable thread tensioning device for the needle threads; devices for locking each needle bar selectively in its highest position; a positioning drive for the multineedle sewing machine; and a device including a position indicator attached to an arm shaft of the multineedle sewing machine, for adjusting the speed of rotation and positioning of the needle bars in predetermined positions. The servo device comprises a control system including a pair of electrical switches which respectively correspond to the needle bars, for controlling the engagement and disengagement of the needle bars relative to the driving and stop devices; a first setting device associated with the control system, for selectively interrupting the transport by the feed dog of the material being sewn; and a second setting device associated with the control system, for temporarily increasing a thread tensioning force exerted on the needle thread by the thread tensioning device.

6 Claims, 4 Drawing Sheets

SERVO DEVICE FOR A MULTINEEDLE SEWING MACHINE WITH ENGAGEABLE AND DISENGAGEABLE NEEDLE BARS

BACKGROUND OF THE INVENTION

The present invention relates to a servo device for a multineedle sewing machine, and more particularly to a servo device for a multineedle sewing machine which includes two needle bars; driving and stop means for said needle bars; means for engaging and disengaging the two needle bars relative to the driving and stop means; a feed-length adjustment device associated with at least one feed dog for the transport of the material being sewn; an adjustable thread tensioning device for the needle threads; means for locking each needle bar selectively in its highest position; positioning drive means for the multineedle sewing machine; and means including a position indicator attached to an arm shaft of the multineedle sewing machine, for adjusting the speed of rotation and positioning the needle bars in predetermined positions.

A switching device for a multineedle sewing machine for optionally engaging and disengaging the needle bars is disclosed in Federal Republic of Germany Utility Model No. 83 35 949, expressly incorporated by reference herein. In that disclosure, the switching device makes it possible for each needle bar, by activation of an electromagnet in cooperation with a pivotally mounted lever mechanism, to be locked in its highest position. In this position, the needle bar is in its disengaged position, i.e., it now cannot be moved either up or down.

The above-mentioned arrangement for engagement or disengagement of the needle bars has the following disadvantages:

1. If the engagement or disengagement is to take place exactly at the top dead center of the needle bars, i.e., at their highest position during the course of their movement, then in the case of so-called corner seams, it will not be possible to terminate two parallel-extending seams precisely at the correct point, before the disconnecting of a needle bar, to provide the proper course of the seam. This problem is due to the relatively large distance between the top surface of the workpiece being sewn and the tips of the sewing needles. As a result, the correct course of the seam is not assured when making corner seams.

2. On the other hand, if the engagement or disengagement is not to take place at the top dead center of the needle bars, then if the seam terminates directly before the disengagement of a needle bar, the above-mentioned distance is decreased or becomes equal to zero, if the tips of the sewing needles contact the top surface of the workpiece, or pass through the workpiece. However, the needle bar which is to be disengaged can only be locked at the top dead center. Therefore, until the moment of disengagement, the part being sewn continues to be pushed forward by an amount which is referred to hereinbelow as a partial stitch length. To avoid damaging the part being sewn, the sewing machine operator must commence the aforementioned termination of the seam in advance, by an amount equal to this partial stitch length, if exact corner sewing is to be obtained. In actual sewing operations, this early termination of the seam, directly before the disengagement of a needle bar, cannot be achieved with the required precision. Thus, here also, the correct course of the seam is not assured when sewing corners.

Furthermore, the engagement and disengagement of the needle bars of a multineedle sewing machine, which may be provided by a ball-detent mechanism, is known, for example, from Federal Republic of Germany Pat. No. 955,023, expressly incorporated by reference herein. Since in this device too, the needle bars are locked at the top dead center, the aforementioned disadvantages are also present in this multineedle sewing machine.

SUMMARY OF THE INVENTION

The object of the invention is to avoid the above-mentioned disadvantages, by providing a servo device which, after the disengaging, as well as after the engaging, of one of the needle bars, permits repeated penetration of the sewing needle, guided by the nondisengaged needle bar, into the needle-penetration hole of the sewing stitch last produced.

This object is achieved by a servo device comprising control means including a pair of electrical switch means which respectively correspond to said needle bars, for controlling the engagement and disengagement of said needle bars relative to said driving and stop means; first setting means associated with said control means, for selectively interrupting the transport by said feed dog of the material being sewn; and second setting means associated with said control means, for temporarily increasing a thread tensioning force exerted on said needle thread by said thread tensioning device.

In the servo device according to an embodiment of the invention, at the same time the disengagement or the engagement of a needle bar begins, the length of advance of the feed dog is set to zero and the thread tension acting on the needle threads is increased. This results in a sewing stitch formed with a feed length of zero, which may be referred to as a "zero stitch." This provides a firm looping—and thus a proper attachment to the part being sewn—of the respective loop thread around the needle thread. In this way, dependable efficient corner sewing of two seams extending parallel to each other is made possible. With the servo device of the invention, for the first time it is possible to economically produce so-called "fashion corners," which are employed in sports jackets, coats and the like.

BRIEF DESCRIPTION OF THE DRAWINGS

Other objects, features and advantages of the invention will be understood from the following detailed description of embodiments thereof, with reference to the drawings, in which.

DETAILED DESCRIPTION OF THE EMBODIMENTS

Figure 1:
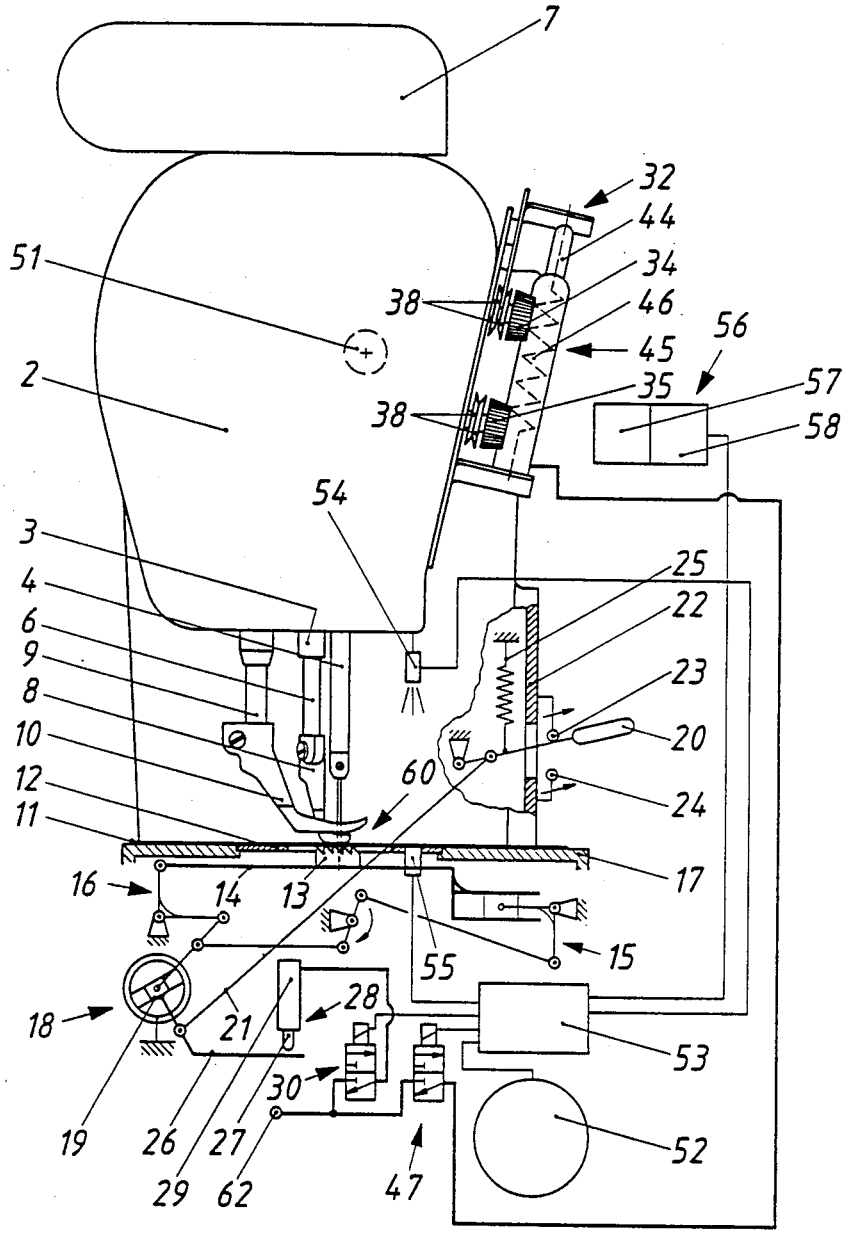
FIG. 1 is a schematic end view, taken from the left of the arm head as shown in FIG. 2, of a multineedle sewing machine having a servo device for the engagement and disengagement of the needle bars, the servo device having setting devices which include pressure-fluid-actuated cylinders.
Figure 2:
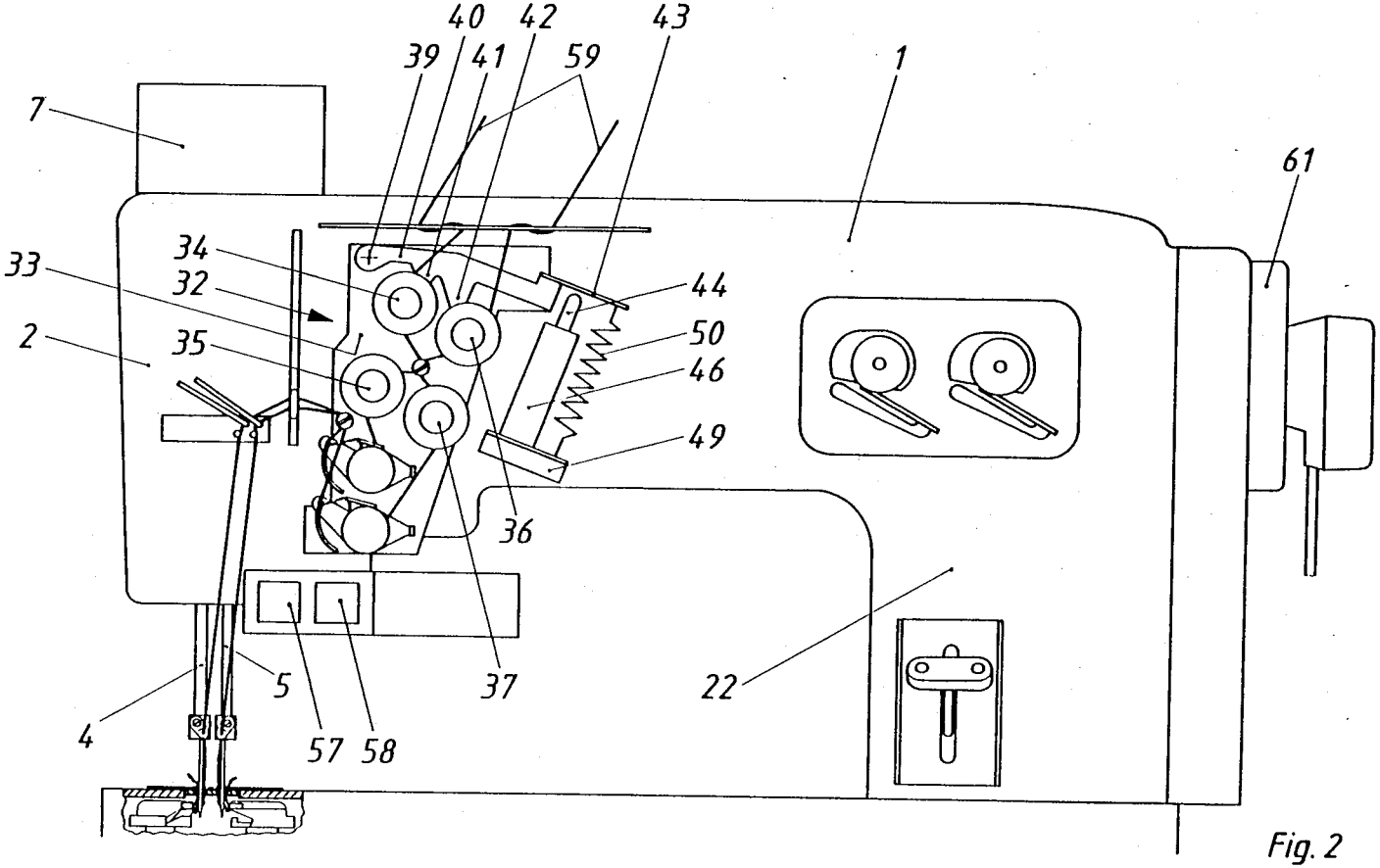
FIG. 2 is a schematic side view of a multineedle sewing machine which includes a thread tensioning device on its arm, the feed foot and the holding foot not being shown in order to clarify the drawing.

FIG. 2 shows a machine arm 1 of a multineedle sewing machine. According to the embodiments shown in FIGS. 1 and 3, the machine arm 1 has both bottom and top feed. The top feed has been described in detail in German Pat. Nos. 23 37 966 and 26 20 209, expressly incorporated by reference herein, so that further description may be dispensed with here. The machine arm 1 is provided at its front end with an arm head 2 in which—as can be noted from the above-mentioned prior patents—a frame 3 is pivotally mounted. Two optionally engageable and disengageable hollow needle bars 4, 5, which are associated with appropriate interior driving means and stop means, and a feed foot bar 6, are supported on the frame 3 for upward and downward movement. The driving means and stop means, for the engagement or disengagement of the needle bars 4, 5, and the engagement or disengagement operations for switching the needle bars, are described in detail in Federal Republic of Germany Pat. No. 955,023, expressly incorporated by reference herein, so their detailed description may be dispensed with here.

As disclosed therein, the needle bars 4, 5 are engaged and disengaged by a remotely controllable switch device 7, including a mechanism which comprises two electromagnets, two pivotally mounted lever mechanisms, and two switch bars which can be moved up and down by the lever mechanisms.

The switch bars are received by the hollow needle bars 4, 5 for engaging and disengaging the latter. The electromagnets, lever mechanisms and switch bars which have just been mentioned, as well as the operation of the switch device 7, need not be described here since they have been described in German Utility Model No. 83 35 949, expressly incorporated by reference herein.

The feed-foot bar 6 supports a feed foot 8 which is movable in a skipping fashion. An upwardly and downwardly movable holding-foot bar 9, which supports a holding foot 10, is mounted in the arm head in a known manner. As disclosed in German Pat. Nos. 23 7 966 and 26 20 209, expressly incorporated by reference herein, the feed foot 8 and the holding foot 10 cooperate for alternately feeding and holding the workpiece being sewn.

Figure 3:
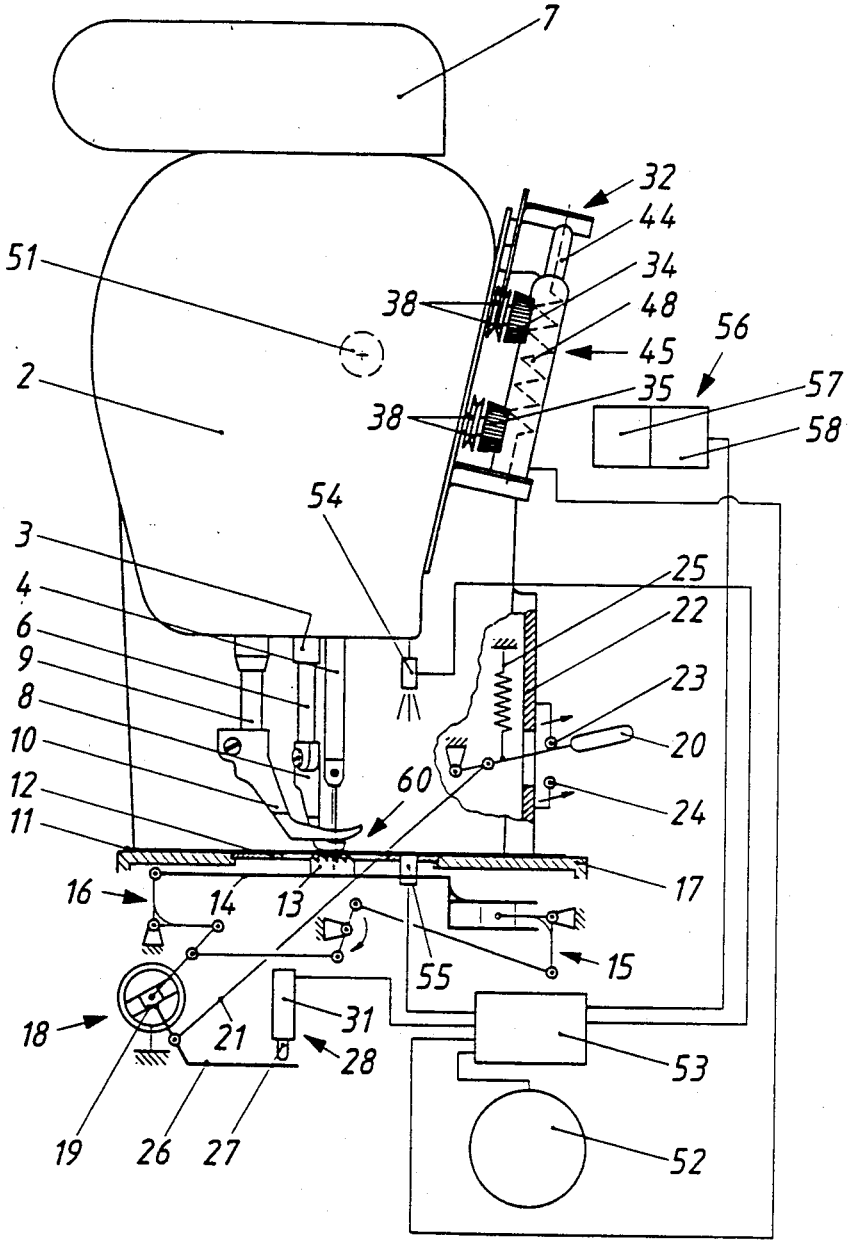
FIG. 3 is a schematic end view of the multineedle sewing machine having a servo device for the engagement and disengagement of the needle bars, the servo device having electromagnetic setting devices.

In order to assure precise transport of the material being sewn, which may be a part 11 consisting of several layers, the skipping feed foot 8 engages the top side of the sewing material 11 between a throat plate 12 and the holding foot 10, as shown in FIGS. 1 and 3, and a skipping feed dog 13 engages the bottom side. The feed foot 8 and feed dog 13 operate completely synchronously with each other.

The feed dog 13 is mounted on a support 14. At the right side of the support 14, as shown in FIG. 1, a lever mechanism 15 engages the support 14 and causes a lifting movement of the feed dog 13. At the left side of the support 14, another lever mechanism 16 engages the support 14 and causes a pushing movement of the feed dog 13. The lever mechanisms 15 and 16 are pivotally mounted in a known manner on a base plate 17 to which, inter alia, the machine arm 1 and the throat plate 12 are connected.

In order to change the length (the stitch length) of a transport step by which the sewing material is advanced, the multineedle sewing machine has a feed-length adjusting device 18, known per se, which comprises the lever mechanism 16 and a slot guide 19 which is pivotally mounted in the base plate 17. In order to change the feed action exerted on the part 11 being sewn, the slot guide 19 is pivoted by a connecting rod 21 in response to the pivoting of a stitch-setting lever 20. The stitch-setting lever 20 extends out of a machine stand 22 in which it is pivotally mounted. The pivoting of the stitch-setting lever 20 is limited by two stops 23, 24 with adjustable position which are arranged on the machine stand 22.

The stitch-setting lever 20 is pulled by a tension spring 25 against the stop 23. In this position, for forward sewing, the feed dog 13, in cooperation with the feed foot 8, moves the part 11 being sewn with a maximum length of feed. If, however, the stitch-setting lever 20 is pressed against the stop 24 in opposition to the action of the tension spring 25, then the sewing material 11 is moved with a maximum length of feed for performing rearward sewing. During the pivoting of the stitch-setting lever 20 which has just been described, it passes through the so-called zero position of the slot guide 19, wherein neither the feed dog 13 nor the feed foot 8 carries out any feeding movement on the part 11 being sewn.

By activating a setting member 28, which is fastened to the base plate 17, a ram 27 can be moved against an extension arm 26 which is firmly connected to the slot guide 19. The setting member 28 can be a single-acting cylinder 29 which is actuated by pressure fluid and which, as shown in FIG. 1, may be controlled via a 3/2-way solenoid valve 30. Alternatively, as shown in FIG. 3, the setting member 28 may have an electromagnet or solenoid 31 for actuation thereof.

On the machine arm 1 there is fastened a thread tensioning device 32, known per se, which comprises a plate 33 with thread tensioning elements 34 to 37 mounted therein. The thread tensioning elements consist in each case of two correspondingly shaped discs 38 which are pressed against each other in known manner by a compression spring with adjustable spring force. In this way, a definite thread tensioning force is imposed upon a needle thread 59 which is passed between the two discs 38 A single-arm lever 40 is mounted pivotally on a pivot point 39 in the plate 33, projections 41, 42 being provided on said lever. The lever 40 has a tongue 43 against which a ram 44 can be applied by activation of a setting member 45. The setting member 45 can be a single-acting cylinder 46 actuatable by pressure fluid which, as shown in FIG. 1, is controlled by a 3/2-way solenoid valve 47, or it can be an electromagnet or solenoid 48 (FIG. 3).

Since in this embodiment both cylinders 29, 6 are activated simultaneously, they may alternatively be controlled via a single 3/2-way solenoid valve, for instance 30. The solenoid valves 30, 47 are connected in a known manner to a source 62 of pressure fluid.

The setting member 45 is firmly connected to the machine arm 1 by an angle plate 49. The pivoting of the lever 40 takes place against the action of a tension spring 50 which is provided between the angle plate 49 and the tongue 43.

An arm shaft 51 of the multineedle sewing machine is driven in known manner by a positioning drive 52. To the arm shaft 51 there is rigidly connected a position indicator 61 which, in known manner, regulates the speed of rotation and the positioning of the needle bars 4, 5 in predetermined positions.

The commands necessary for the engagement and/or disengagement of the needle bars 4, 5 are given via a control 53 which may suitably be integrated in a control device, not shown here, which is part of the positioning drive 52.

Arranged at an adjustable position on the arm head 2 is a light barrier which comprises a transmitter 54 and a receiver 55. The latter is preferably arranged in the throat plate 12 in such a manner that it does not interfere with the movement of the feed dog 13.

Two electric switch elements 56 for the engagement and disengagement of the needle bars 4 and 5 respectively are also provided on the arm head 2 and therefore in the vicinity of a sewing point 60. In the preferred embodiment, the switch elements 56 are push buttons 57, 58. As can be noted from FIGS. 1 and 3, the transmitter 54, the receiver 55 and the push buttons 57, 58 are connected in a circuit with the control 53. Thus, either interrogation of the light barrier (transmitter 54, receiver 55), or actuation of the push buttons 57, 58, will cause switch signals which will be supplied to the control 53.

The manner of operation of the servo device of the invention will now be described.

Figure 4:
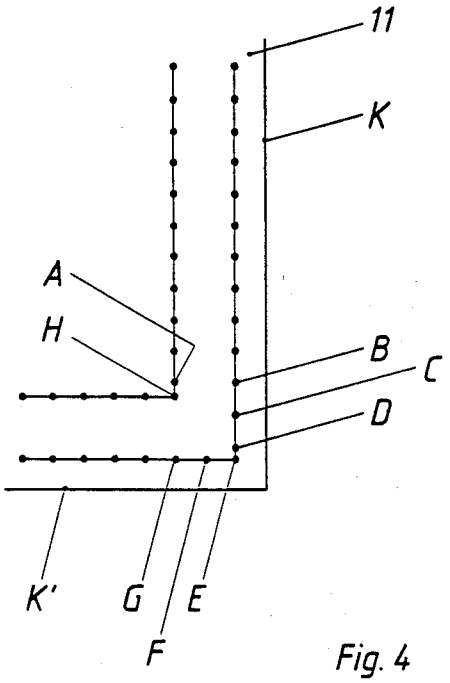
FIG. 4 is a diagram showing two seams produced by a multineedle sewing machine, for use in explaining the invention.

A multineedle sewing machine produces seams extending parallel to the edge K (FIG. 4) of a part 11 being sewn. As a rule, these seams follow an angular course at acute, obtuse, or right-angle corners of the part being sewn. However, in the case of sewing seams as shown in FIG. 4, the sewing process is interrupted upon reaching the needle-penetration holes A and B, the positioning drive 52 positioning both sewing needles in their lowest position. The penetration holes A and B must be at such a distance from the edge K' of the part 11 being sewn that the following penetration hole H is at the same distance from both the edges K and K'. The interruption of the sewing process at A and B is brought about by transmitter 54 and receiver 55, which sense the edge K' of the part 11 being sewn.

Upon the interruption of the sewing process, in which the sewing needles are positioned in lowest position at A and B, the disengagement of the needle bars 4, 5 is effected by depressing the switch elements 56. With the seam shown in FIG. 4, the needle bar 4 must be disengaged by pressing the push button 57 for sewing the corner. In this way the following operations are simultaneously brought about:

(a) The arm shaft 51 carries out a further revolution.

(b) The activated setting member 28 pivots the slot guide 19 into its "zero position" in which no feed action is exerted on the part 11 being sewn.

(c) The activated setting member 45 pivots the lever 40 in the counter-clockwise direction, as a result of which additional thread tensioning forces are imposed on the needle threads 59 by the thread tensioning elements 34 and 36.

(d) The corresponding electromagnet which is in the switch device 7 is energized and effects the disengagement of the corresponding needle bar 4.

After the completion of the revolution carried out by the arm shaft 51, the needle bar 4 is locked in its highest position (top dead center), i.e., disengaged, while the sewing needle borne by the nondisengaged needle bar 5 again enters into the penetration hole B of the last sewing stitch produced, and is positioned in its lowest position. In order for the sewing needle borne by the needle bar 5 to then proceed to the corner of the part 11 being sewn at a predetermined place, it must carry out at least one additional sewing stitch. With the seam shown in FIG. 4, two additional sewing stitches must be produced, having the penetration holes C and D. These individual sewing stitches are produced either with the pedal or by depressing a third push button, not shown here.

To locate the corner penetration hole E with precision, it is necessary for the last sewing stitch DE to be produced with a stitch length which differs from that of the sewing stitches previously made. The necessary stitch length is estimated by the operator of the sewing machine and is either set on the stitchsetting lever 20, or else an adjustably set partial stitch length is carried out by depressing a further push button, not shown here. The sewing needle 5 is now located in the penetration hole E and in its lowest position. This makes it possible, after lifting the holding foot 10, for the part 11 being sewn to turn around the sewing needle of the needle bar 5, whereby the part 11 is positioned for the following sewing process, in which both seams will extend parallel to the edge K'.

After the part 11 has been turned around the needle at E as previously described, at least one further sewing stitch is produced with the needle bar 4 still disconnected. If the stitch length is, for instance, half as large as the distance between the two seams, then after the turn around E, two sewing stitches must be carried out. In this connection it is noted that the penetration hole G should lie on the alignment line of the inner seam (see FIG. 4). In this connection also, the necessary stitch length must be estimated by the operator of the machine and be carried out by adjustment of the stitch setting lever 20 or by depressing the aforementioned fourth push button (not shown).

After the completion of the sewing stitch FG the sewing needle borne by the non-disconnected needle bar 5 is within the penetration hole G and in its lowest position. Now, by again depressing the push button 57, the needle bar 4 is again engaged, and the functions (a) to (d) described previously take place again in a similar manner. The sewing needle of the needle bar 4 is then within the penetration hole H. Thus, the sewing stitch AH has been formed while the sewing needle of the needle bar 5 was penetrated into the penetration hole G of the sewing stitch last produced. Thereupon, the needle bars 4, 5 are again engaged and in their lowest position, so both of the seams illustrated along side K' in FIG. 4 can continue to be produced in the normal manner, starting with the penetration holes G and H.

The preceding discussion of embodiments of the invention has been illustrative rather than limiting. Therefore, the appended claims should not be so limited, but should be construed to include modifications and variations thereof which may occur to those of ordinary skill in the art, within the spirit and scope of the invention disclosed herein.

What is claimed is:

1. A servo device for a multineedle sewing machine which includes two needle bars; driving and stop means for said needle bars; means for engaging and disengaging the two needle bars relative to the driving and stop means; a feed-length adjustment device associated with at least one feed dog for the transport of the material being sewn; an adjustable thread tensioning device for the needle threads; means for locking each needle bar selectively in its highest position; positioning drive means for the multineedle sewing machine; and means including a position indicator attached to an arm shaft of the multineedle sewing machine, for adjusting the speed of rotation and positioning the needle bars in predetermined positions; said servo device comprising:

control means including a pair of electrical switch means which respectively correspond to said needle bars, for controlling the engagement and disengagement of said needle bars relative to said driving and stop means;

first setting means associated with said control means, for selectively interrupting the transport by said feed dog of the material being sewn; and second setting means associated with said control means, for temporarily increasing a thread tensioning force exerted on said needle thread by said thread tensioning device.

2. A servo device as in claim 1, wherein said first and second setting means are actuatable simultaneously by said control means

3. A servo device as in claim 1, wherein said first setting means includes a cylinder which is actuatable by a pressure fluid and is controlled via a solenoid valve connected to said control means, and said second setting means includes a second cylinder which is actuatable by pressure fluid and is controlled via a second solenoid valve connected to said control means.

4. A servo device as in claim 1, wherein said first and second setting means both include electromagnetic means connected to said control means.

5. A servo device as in claim 1, wherein each said adjustable thread tensioning device for each respective needle thread includes a pair of thread tensioning elements through which the respective needle thread passes.

6. A servo device as in claim 1, wherein each said electrical switch means comprises a push button switch.

* * * * *